US006113085A

United States Patent [19]

Lindenthal et al.

[11] Patent Number: 6,113,085

[45] Date of Patent: Sep. 5, 2000

[54] CLAMPING DEVICE

[75] Inventors: Norbert Lindenthal, Bad Ems; Hans Roesch, Gemmrigheim, both of Germany

[73] Assignee: Bessey & Sohn GmbH & Co., Bietigheim-Bissingen, Germany

[21] Appl. No.: 09/170,322

[22] Filed: Oct. 13, 1998

Related U.S. Application Data

[63] Continuation of application No. PCT/EP97/00737, Feb. 17, 1997.

[51] Int. Cl.[7] ..... B25B 5/02

[52] U.S. Cl. ..... 269/6; 269/170

[58] Field of Search ..... 269/165–171.5, 269/147–150, 6; 81/487

[56] References Cited

U.S. PATENT DOCUMENTS 4,989,847 2/1991 Chapman .
5,197,360 3/1993 Wooster, Jr. .

FOREIGN PATENT DOCUMENTS 40 28 274 3/1991 Germany .
2 204 264 11/1988 United Kingdom .

*Primary Examiner*—Robert C. Watson
*Attorney, Agent, or Firm*—Barry R. Lipsitz; Douglas M. McAllister

[57] ABSTRACT

In order to improve a clamping device comprising a guide rail, a first clamping element supported on the guide rail and having a first clamping surface formed by a pressure member of a clamping spindle and movable in a clamping direction, a slide bracket guided on and movable along the guide rail and fixable by a first wedging element, and a feed device including a second wedging element supportable on the guide rail and a pivotally mounted feed lever lying with its handle between the guide rail and the clamp grip of the clamping spindle, and a second clamping element supported on the guide rail and having a second clamping surface, such that ergonomically it can be installed more expediently on a workpiece, and the workpiece can thereby be finally clamped, it is proposed that the feed lever act with a first pressure member between the second wedging element and the slide bracket such that upon actuation of the feed lever in the direction of the clamp grip of the clamping spindle, the slide bracket is displaceable in the clamping direction relative to the second wedging element.

31 Claims, 5 Drawing Sheets

Figure 1:
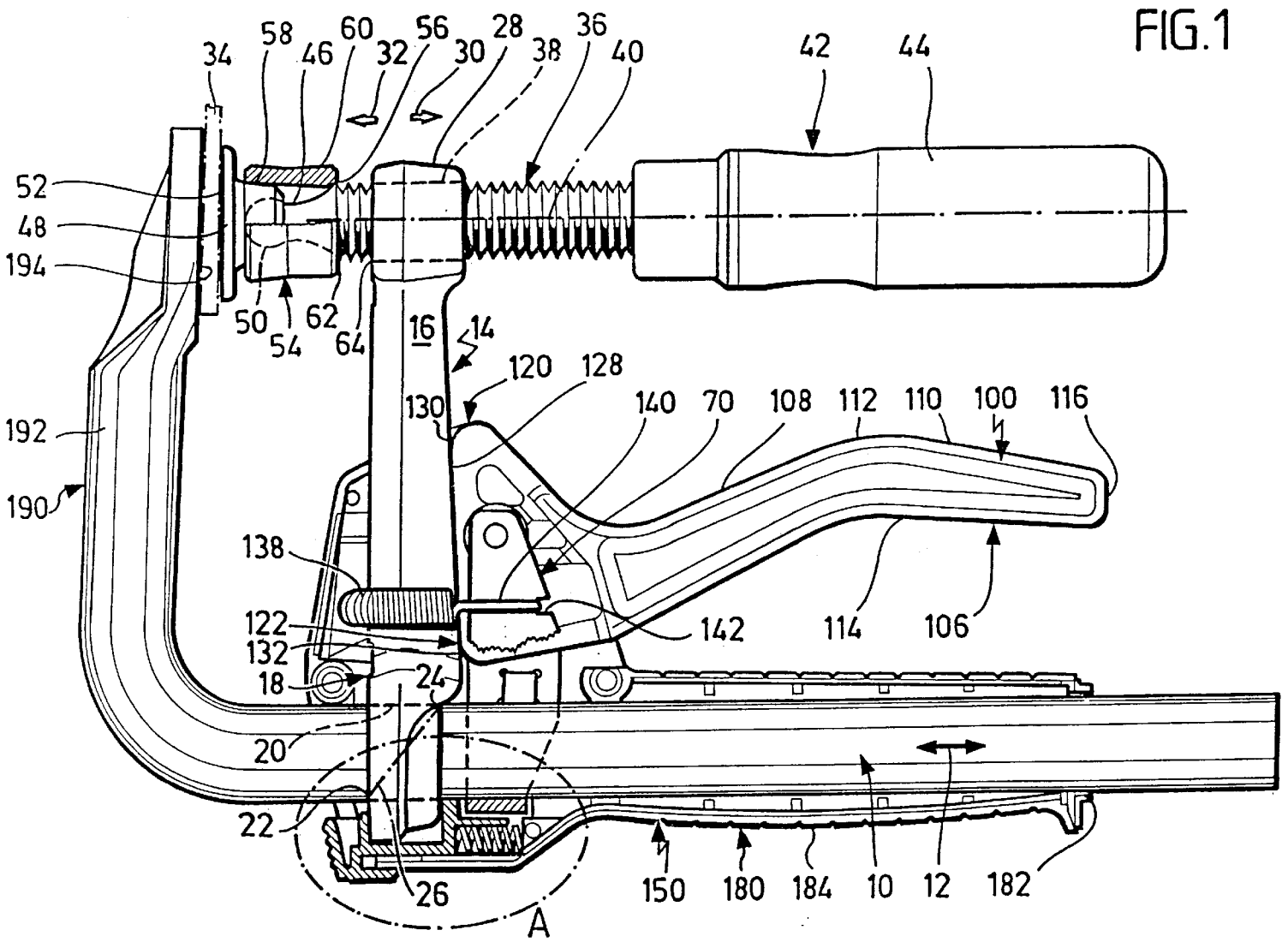

44
42
40
36
38
28
30
56
32
60
46
58
34
52
48
194
192
190
16
14
130
120
128
140
70
108
112
110
100
116
106
114
142
138
122
132
18
20
22
24
26
64
62
54
50
6
12
10
184
180
150
182
A

CLAMPING DEVICE

This application is a continuation of PCT/EP97/00737 filed Feb. 17, 1997.

The invention relates to a clamping device comprising a guide rail, a first clamping element supported on the guide rail and having a first clamping surface formed by a pressure member of a clamping spindle and movable in a clamping direction, a slide bracket guided on and movable along the guide rail and fixable by a first wedging element, the slide bracket carrying a spindle nut through which the clamping spindle extends, and a feed device including a second wedging element supportable on the guide rail and a pivotally mounted feed lever lying with its handle between the guide rail and a clamp grip of the clamping spindle, the slide bracket being displaceable in the clamping direction by the feed lever relative to the second wedging element, and a second clamping element supported on the guide rail and having a second clamping surface.

Such a clamping device is known, for example, from U.S. Pat. No. 4,989,847.

However, this clamping device is awkward to operate. It is possible to displace the first clamping element relative to the second clamping element with one hand in order to first install the clamping device. To do so, the feed lever is moved in the direction of the guide rail, and a projection extending on one side of the guide rail opposite the feed lever is provided as support for the hand.

However, to fix the clamping device by means of the clamping spindle it is necessary to use the second hand to turn the clamp grip, in order to tighten the spindle, and only after the second hand engages the clamp grip is it possible to remove the hand acting on the feed lever from the clamping device.

The object underlying the invention is, therefore, to improve a clamping device of the generic kind such that ergonomically it can be installed more expediently on a workpiece, and final clamping of the workpiece can thereby be carried out.

This object is accomplished in a clamping device of the kind described at the outset, in accordance with the invention, in that the feed lever acts with a first pressure member between the second wedging element and the slide bracket such that upon actuation of the feed lever in the direction of the clamp grip of the clamping spindle, the slide bracket is displaceable in the clamping direction relative to the second wedging element.

The advantage of the inventive solution is to be seen in that by displacement of the slide bracket upon actuation of the feed lever in the direction of the clamp grip of the spindle, the possibility was created of holding the inventive clamping device with one hand, on the one hand, at the clamp grip, and, on the other hand, at the feed lever, and of installing it in this position on the workpiece. In this position, the first clamping element is first movable in the clamping direction by actuation of the feed lever, with the hand already resting on the clamp grip of the clamping spindle.

After a first installation of the inventive clamping device, it is then possible, with the hand already resting on the clamp grip of the clamping spindle, to tighten the clamping spindle further, and the hand can in a simple way let go of the feed lever and still hold the clamp grip of the clamping spindle, for example, between the palm of the hand, the thumb and the ball of the thumb, so that with one and the same hand, on the one hand, the first clamping element is displaceable, and then with the clamping device already installed, the full clamping force can be applied by further turning of the clamping spindle, without it being necessary to use a second hand and to first hold the clamping device with it at the clamp grip.

In principle, it is possible to connect the first pressure member articulatedly to the feed lever, and, for example, even a transmission of motion via an articulated connection is possible.

However, with a view to a particularly simple solution, it is expedient for the first pressure member to be rigidly connected to the feed lever.

In conjunction with the preceding embodiments, no further details were given as to the mounting of the feed lever. It is, for example, conceivable for the feed lever to be mounted on the slide bracket or on the first wedging element.

With a view to a particularly simple and compact construction, it is, however, particularly expedient for the feed lever to be mounted on the second wedging element as the action of the first pressure member on the slide bracket is then realizable in a particularly simple way.

A particularly expedient possibility of realizing the mounting in a structurally simple way makes provision for the feed lever to be mounted on the second wedging element for pivotal movement about a pivot axis, and for the first pressure member to be movable in the direction of the slide bracket upon actuation of the feed lever. A movement of the first pressure member sliding the slide bracket in the clamping direction is thereby realizable in a simple way.

The first pressure member could also act on the slide bracket via an interposed part or an intermediate member. However, likewise with a view to a particularly simple structural solution, it is advantageous for the first pressure member to act directly on the slide bracket.

Furthermore, the action on the first slide bracket is also realizable in various ways. For reasons of simplicity, it has similarly proven to be relatively expedient for the first pressure member to act on an area of the slide bracket extending between the guide rail and the clamping spindle, preferably between the pivot axis of the feed lever and the clamping spindle.

Very different ways of bringing about the wedging of the second wedging element by tilting are conceivable. It is, for example, conceivable to allocate to the second wedging element a spring element which holds it in a wedged position so the feed lever could be arranged in an optional way on the second wedging element.

A particularly expedient construction which is distinguished, in particular, by its functionability makes provision for the feed lever to be arranged on the second wedging element such that upon actuation of the feed lever, a pressure acting from the feed lever on the second wedging element in the direction opposite to the clamping direction causes wedging of the second wedging element by tilting and fixing thereof brought about by the wedging.

This means that, in this embodiment, the force acting in any case on the mounting of the feed lever in the direction opposite to the clamping force can be used to wedge the second wedging element by tilting, which eliminates the necessity for an additional spring element to apply this force. Furthermore, this solution has the advantage that when the feed lever is not actuated, there are no high forces acting on the second wedging element, and, therefore, the second wedging element can also be made to follow the slide bracket in a simple way, without the necessity for high frictional forces such as, for example, in the case of a wedging element which is always held in a wedged position by a spring element.

Within the scope of the solution described so far, merely features which define the function of the inventive clamping device upon actuation of the feed lever in the direction of the clamp grip were explained. A particularly expedient solution, in particular, one which is universally applicable, makes provision for the feed lever to act on a second pressure member, and, upon actuation of the feed lever in the direction of the guide rail, for the slide bracket to be displaceable by the second pressure member in the clamping direction relative to the second wedging element.

This solution has the great advantage that the clamping device is universally actuatable, i.e., depending on the space requirement and the intended use, it is possible, on the one hand, to displace the first clamping element by the feed lever being moved in the direction of the clamp grip, but, it is, on the other hand, also possible to displace the first clamping element in the same direction by the feed lever being moved in the direction of the guide rail, and, therefore, depending on the desired use, universal handling is possible.

With this solution, too, it is particularly expedient for the second pressure member to be fixedly connected to the feed lever.

A mechanically particularly expedient solution makes provision for the first and the second pressure members to be integrally formed on the feed lever, as a particularly simple and advantageous manufacture of the inventive clamping device is thereby made possible.

Herein it has proven expedient for the first and the second pressure members to be arranged approximately symmetrically in relation to the pivot axis of the feed lever so that upon movement of the feed lever in the direction of the clamp grip and in the direction of the guide rail, approximately the same displacement paths of the slide bracket are attainable.

Provision is preferably made for the first and the second pressure members to act on the area of the slide bracket lying between the guide rail and the clamping spindle, and, therefore, the slide bracket is always displaceable in a simple way in the clamping direction independently of the direction of the pivotal movement of the feed lever.

For the arrangement of the second pressure member, it has proven particularly expedient for the second pressure member to act on an area of the slide bracket lying between the pivot axis of the feed lever and the guide rail as, in this case, a force exerted by the pressure member acts on the slide bracket with a moment which does not counteract a wedging moment.

To ensure that the second wedging element always follows the slide bracket, in particular, when, after actuation of the feed lever, one lets go of the feed lever, provision is advantageously made for the second wedging element to be acted upon by a drive spring element in the clamping direction. This means that this drive spring element always acts on the second wedging element such that it goes into its position closest to the slide bracket.

To give the drive spring element a suitable support, provision is made for the drive spring element to engage a part which is movable along with the slide bracket.

Such a part movable with the slide bracket may be the slide bracket itself or it is possible to use a housing, for example, taken along by the slide bracket, as a bearing support or rest for the drive spring element.

In the simplest case, provision is made for the drive spring element to be a drag spring element which engages the slide bracket.

This drive spring element can, in principle, engage any point on the second wedging element so long as it always makes the second wedging element follow the slide bracket. However, a particularly expedient solution makes provision for the drive spring element to act on the second wedging element such that the second wedging element stands free of play in a wedged position so that, for example, with actuation of the feed lever and the resulting force exerted on the second wedging element, the wedging of the second wedging element is usable in a play-free manner, and, therefore, the second wedging element does not first have to overcome play between the opening provided for the wedging and the guide rail in order to reach the wedged position.

In conjunction with the preceding embodiments, no further details were given as to the design and arrangement of the first wedging element.

It is, for example, conceivable to arrange the first wedging element as a separate part alongside a slide bracket with a guide opening for the guide rail. Since this is complicated, and, in particular, in such a case, the force additionally exerted by the clamping spindle would also not reinforce the wedging of the first wedging element by tilting, provision is preferably made for the first wedging element to be rigidly connected to the slide bracket.

It is particularly advantageous for the first wedging element to be integrally formed on the slide bracket and to thus constitute a part thereof.

In this case, in order to ensure that the first wedging element assumes its wedged position following advancement by the feed lever, provision is preferably made for the first wedging element to be acted upon by a wedging spring element which holds the first wedging element in its wedged position also upon actuation of the feed lever.

This means that independently of how the feed lever acts on the slide bracket and hence the first wedging element, the force of the wedging spring element is always so great that the first wedging element remains in its wedged position.

The wedging spring element may be arranged in different ways. For example, it is conceivable for the wedging spring element to be supported directly on the guide rail. However, it is particularly advantageous for the wedging spring element to be supported on a housing guided on the guide rail.

In this case, relative displacement between the first wedging element and the housing can be eliminated by different measures.

However, since as great a force as possible is to be exerted with the inventive wedging spring element in order to bring about wedging, provision is preferably made for the housing to be supported with a bearing support on the first wedging element so that the bearing support and the wedging spring element together bring about the wedging of the first wedging element.

In order to apply as great a force as possible, provision is made for the bearing support and a place at which the wedging spring element acts on the first wedging element to be spaced at as large a distance as possible from one another, and, preferably, to be arranged on opposite sides of the guide rail.

In order to also provide the possibility of releasing the wedging of the first wedging element, for free displacement of the first clamping element, it is, for example, conceivable to provide the first wedging element with an attachment which is manually actuatable and upon whose actuation the wedging of the first wedging element is releasable.

A particularly advantageous solution makes provision for the housing to comprise a bearing for a manually actuatable release member which acts on the first wedging element, and for the wedging of the first wedging element to be releasable by the release member upon actuation thereof.

In an advantageous embodiment, this release member is in the form of a slide which is displaceably mounted on the housing.

In order to advantageously release the action of the wedging spring element with this release member, but, on the other hand, in order to also maintain it fully when the release member is not actuated, provision is preferably made for the wedging spring element to act on the release member in order to hold it and the first wedging element in the wedged position insofar as the release member is not actuated.

In conjunction with the above description of the individual embodiments, no further details were given as to the design of the housing. An advantageous embodiment makes provision for the housing to enclose at least partially the first wedging element, the second wedging element and the slide bracket, on the one hand, in order to support these, and, on the other hand, in order to also accommodate the components acting on them.

Furthermore, provision is preferably made for the housing to be provided with a grip portion surrounding the guide rail and extending in the area of the handle of the feed lever for engagement by the hand upon actuating the feed lever in the direction of the guide rail.

In order to use the housing, for example, as support for the wedging spring element, provision is made for the housing to be movable along with the slide bracket.

The housing can be movable in different ways. It is particularly advantageous for the housing to be movable along with the slide bracket by it resting with the bearing support against the first wedging element.

So far, no further details were given as to the design of the clamping spindle and the pressure member usable therewith. An advantageous embodiment makes provision for the clamping spindle to carry at its end facing the pressure member a rotary stop member made of deformable material.

The rotary stop member serves to provide a rotary stop to prevent turning out of the clamping spindle.

Owing to the rotary stop member being made of a deformable material, the stop is not an absolutely rigid stop. In spite of the initial engagement of the stop, there is the possibility, when clamping has been carried out inadvertently with the rotary stop member already in engagement, to rotate the clamping spindle additionally in the direction of its releasing position, with the rotary stop member thereby undergoing deformation, in order to obtain adequate release of the pressure member to then be able to release the wedging of the first wedging element again and thus displace the entire first clamping element.

Provision is preferably made for the rotary stop member in its operative position in the undeformed state to prevent adjustment of the clamping spindle as far as a completely open position, and for the completely open position of the clamping spindle, which does not allow any further turning, to only be attainable by deformation of the rotary stop member.

Furthermore, a particularly expedient solution makes provision for the rotary stop member to simultaneously act as alignment member for the pressure member articulatedly connected to the clamping spindle and to thus at least limit an articulated movement of the pressure member relative to the clamping spindle, but, on the other hand, on account of its elasticity to allow further pivotability of the pressure member upon application of force.

Figure 4:
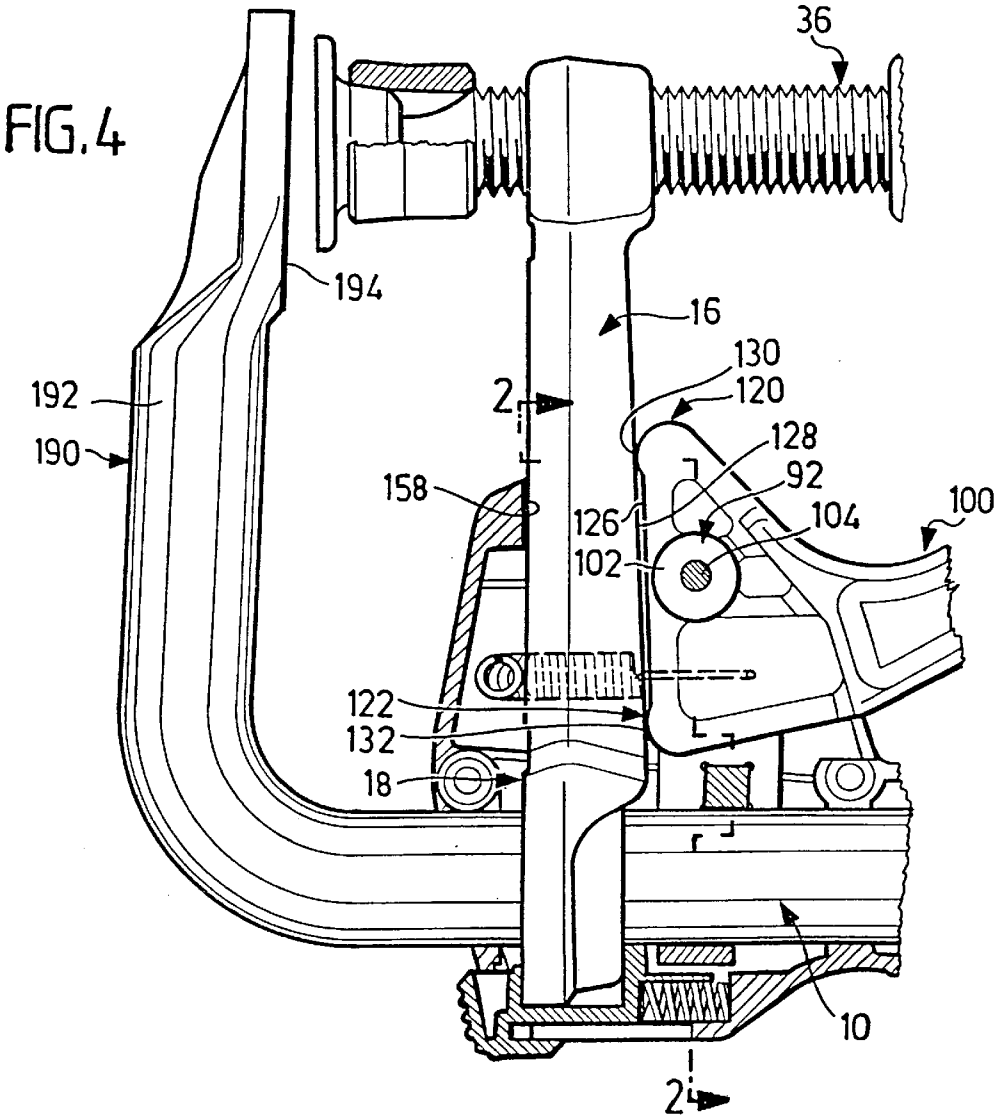
Figure 2:
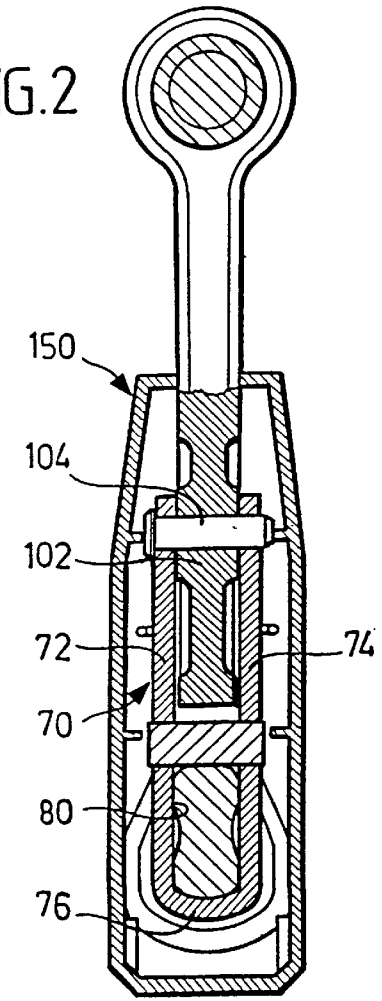
Figure 3:
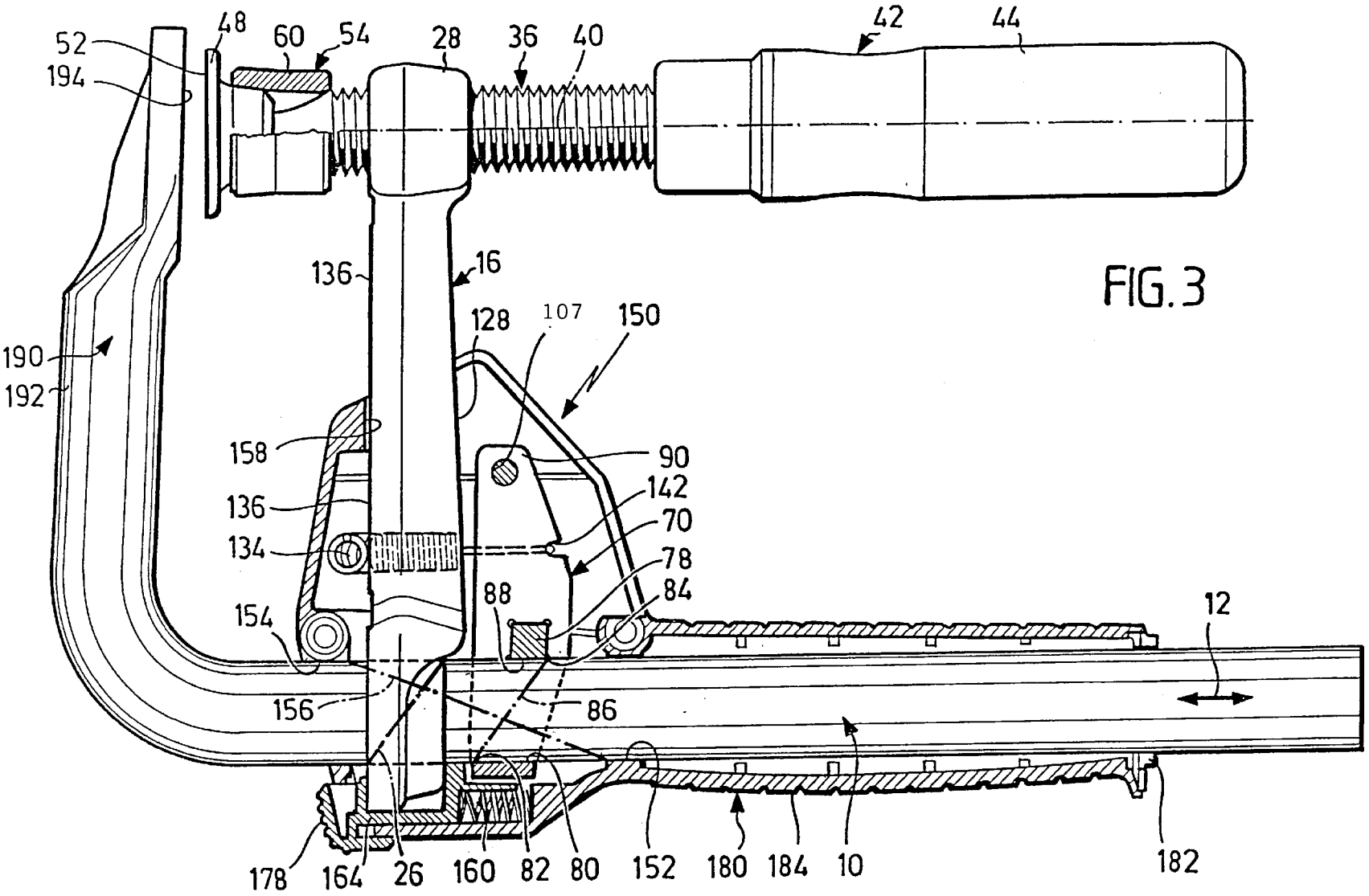
Figure 5:
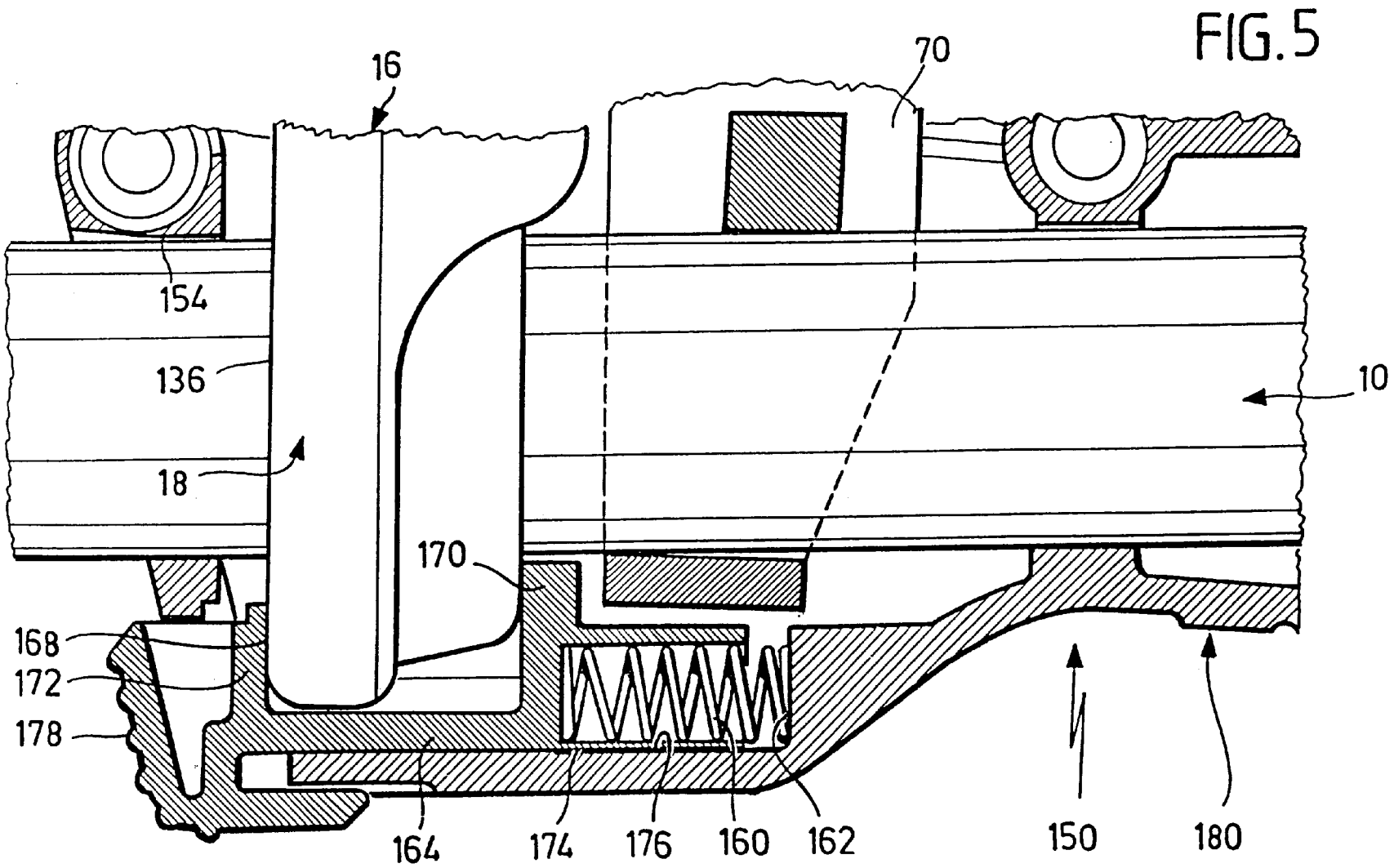
Figure 6:
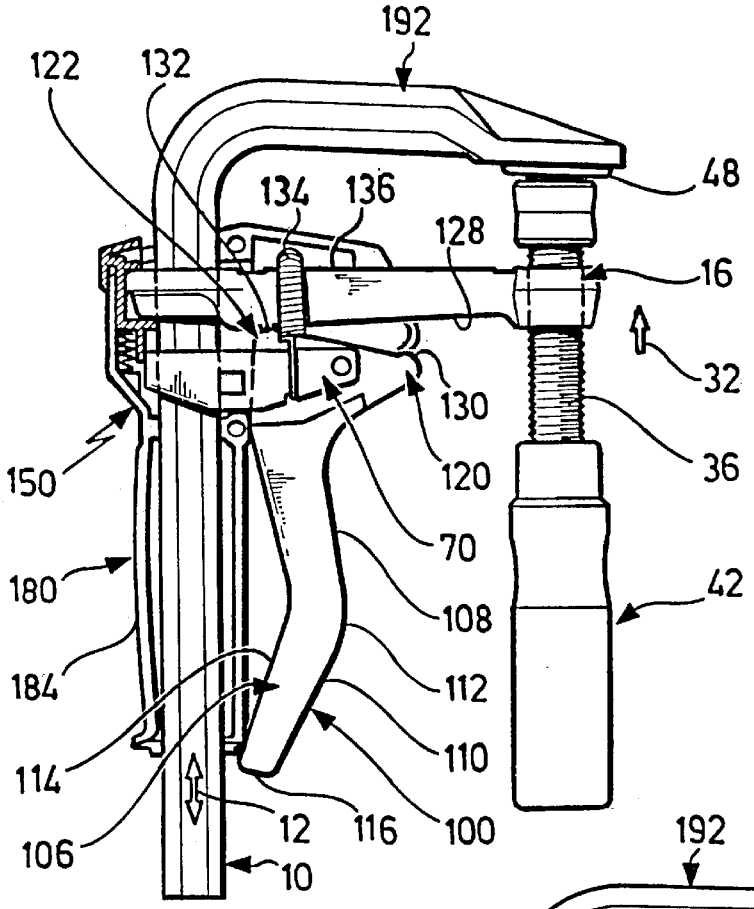
Figure 7:
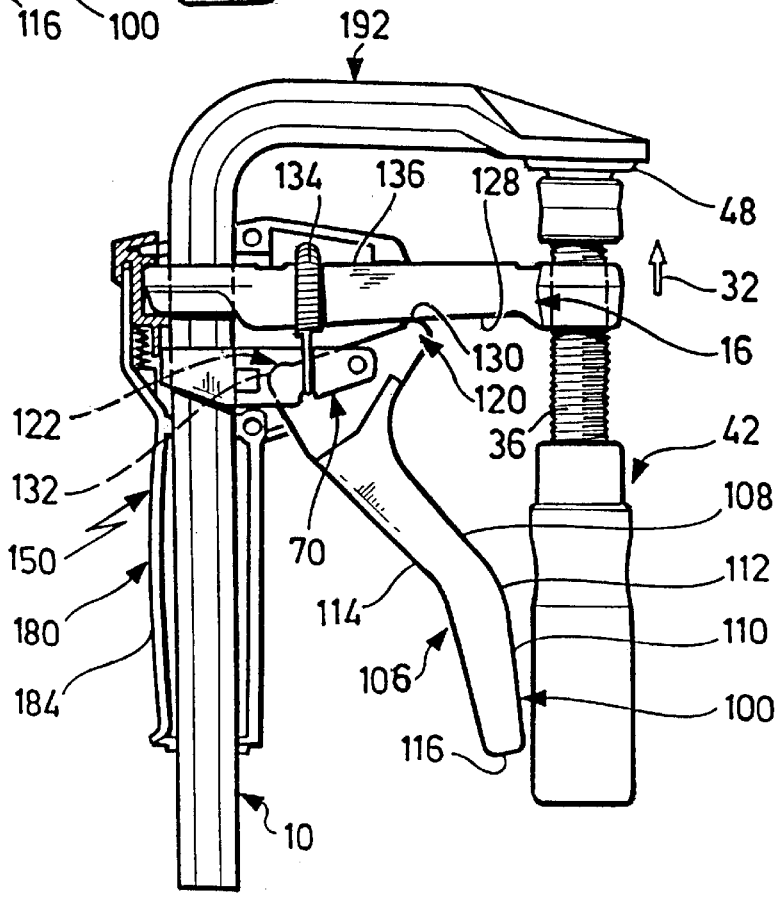

Further features and advantages of the invention are the subject matter of the following description and the drawings of an embodiment. The drawings show:

FIG. 1 a side view of an inventive clamping device, with cut-open housing and partly broken away second wedging element;

FIG. 2 a section taken along line 2—2 in FIG. 4;

FIG. 3 a section similar to FIG. 1 with housing in section and second wedging element in section without feed lever;

FIG. 4 a section similar to FIG. 3 with inserted feed lever;

FIG. 5 an enlarged section of an area A in FIG. 1;

FIG. 6 a section similar to FIG. 1 with feed lever actuated in the direction of the guide rail; and FIG. 7 a section similar to FIG. 1 with feed lever actuated in the direction of the clamp grip.

An embodiment of an inventive clamping device, shown in FIG. 1, comprises a guide rail, generally designated 10, in particular, in the form of a guide rail of a clamping clip, which extends in a longitudinal direction 12. A first clamping element, generally designated 14, is guided on this guide rail 10 for displacement in the direction of the longitudinal direction 12.

The first clamping element 14 comprises a slide bracket 16 which extends approximately transversely to the longitudinal direction 12 of the guide rail 10 and on which a first wedging element 18 is integrally formed.

The first wedging element 18 comprises an opening 20, through which the guide rail 10 is guided, and diagonally opposed wedge rests 22 and 24 in the opening 20 between which the wedge diagonal 26 extends.

The wedge diagonal 26 lies such that upon acting on an end 28 of the slide bracket 16 located opposite the first wedging element 18 with a force 30 acting opposite to a clamping direction 32, the first wedging element 18 is fixed by frictionally engaged fixing of the wedge rests 22 and 24 on the guide rail 10. When the action of the force 30 on the end 28 is removed, the first wedging element 18 is displaceable along the guide rail 10 and positionable at any point thereon.

A clamping spindle, generally designated 36, is provided for clamping a workpiece 34. The clamping spindle extends through an area of the end 28 in the form of a spindle nut 38 and is movable relative to the end 28 by rotation about its spindle axis 40. The spindle axis 40 preferably extends approximately parallel to the longitudinal direction 12 of the guide rail 10.

The clamping spindle 36 is provided with a clamp grip 42 for turning it. On a side of the clamping spindle 36 facing away from the spindle nut 38, the clamp grip also extends approximately parallel to the longitudinal direction 12 of the guide rail 10 and preferably has a grip surface 44 extending approximately cylindrically in relation to the spindle axis 40.

At its end 46 opposite the clamp grip 42, the clamping spindle 36 also carries a pressure member, generally designated 48, which is connected to the end 46 of the clamping spindle 36 preferably via a joint movable on all sides, preferably a ball-and-socket joint 50.

On its side facing away from the ball-and-socket joint 50, the pressure member 48 has a clamping surface 52 with which it acts upon the workpiece 34 to be clamped.

To hold the pressure member 48, which on account of the ball-and-socket joint 50 tilts with the gravitational force, in alignment, in order to install the inventive clamping device, such that the pressure surface 52 extends approximately perpendicularly to the spindle axis 40, an alignment member 54 is provided between the pressure member 48 and the end 46 of the clamping spindle 36, preferably in an area surrounding the ball-and-socket joint 50 formed between these.

The alignment member 54 is preferably in the form of a sleeve made of elastic material which rests on its side facing the spindle nut 38, preferably in the form of an annular contact surface, at the end 46 of the clamping spindle 36, and on its side facing the pressure member 48 preferably embraces with a cylindrical attachment 60 a conical portion 58 arranged opposite the pressure surface 52 and extending in the direction of the end 46 of the clamping spindle 36 and is fixed thereon.

The alignment member 54 also serves as rotary stop member, for which purpose it has at its end face an annular surface 62 facing the spindle nut 38. When the clamping spindle 36 is turned back in the direction opposite to the clamping direction 32, the annular surface 62 comes to rest against an end face 64 of the spindle nut 38 facing the annular surface and thus only allows further turning back of the clamping spindle 36 by the rotary stop member 54 undergoing deformation in its entirety in its extent between the annular surface 62 and the cylindrical attachment 60, with shortening of the spacing between these.

Accordingly, when turning back the clamping spindle 36, the operator will terminate this when the annular surface 62 comes to rest against the end face 64. If, with the annular surface 62 resting against the end face 64, clamping of a workpiece 34 has been effected by the pressure member 48, and the first wedging element 18 is wedged owing to the clamping force 30 acting on the slide bracket 16, with the result that it is difficult to release it, release of the clamping force 30 can be carried out in a simple way by the clamping spindle 36 being turned back, whereby the rotary stop member 54 undergoes deformation, and, in particular, its extent between the annular surface 62 and the cylindrical attachment 60 is shortened. Merely a slight movement is sufficient to release the clamping of the workpiece 36 and thus allow the force 30 to decrease or even be eliminated, so that displacement of the first wedging element 18 together with the slide bracket 16 is then possible again.

A second wedging element 70 is provided on a side of the slide bracket 16 located opposite the pressure member 48 for displacing the slide bracket 16 in the clamping direction 32. As shown in FIGS. 2 and 3, the second wedging element has two side portions 72 and 74 extending parallel to each other and connected to each other by a cross portion 76 integrally formed thereon. Also provided at a distance from the cross portion 76 is a wedging bolt 78 which likewise extends between the side portions 72 and 74.

The side portions 72 and 74 form together with the cross portion 76 connecting these and the wedging bolt 78 arranged at a distance from the cross portion 76 an opening 80 through which the guide rail 10 extends. The opening 80 also has two wedge rests 82 and 84 which are arranged in diagonally opposite relation to each other in the opening 80 and are joined to each other by a wedge diagonal. The wedge diagonal 86 is inclined in the same direction as the wedge diagonal 26 to the longitudinal direction 12 of the guide rail 10.

The wedging bolt 78 is preferably arranged as bolt with a rectangular cross-sectional shape, with a flat side 88 facing the guide rail 10 and forming with a partial area the wedge rest 84.

The second wedging element 70 extends transversely to the longitudinal direction 12 beyond the wedging bolt 78 in the direction of the clamping spindle 36 and approximately parallel to the slide bracket 16 and carries in the area of its end 90 facing the clamping spindle 36 a pivot bearing 92 for a feed lever generally designated 100. In the simplest case, the pivot bearing 92 is formed by a bearing pin 104 extending through the feed lever 100 in the area of a bearing eye 102 and also extending through corresponding receptacles 106 in the area of the ends 90 of the side portions 72 and 74.

Starting from the bearing eye 102, the feed lever 100 extends with a handle 106 between the guide rail 10 and the clamp grip 42. The handle 106 has a first portion 108 facing the bearing eye 102, including an acute angle with the guide rail 10 and extending away from the guide rail 10. Adjoining the first portion 108 is a second portion 110 which lies approximately at the center between the clamp grip 42 and the guide rail 10. In an area of transition from the first portion 108 to the second portion 110, the feed lever 100 forms on a side facing away from the guide rail 10 a grip curvature 112, and the second portion 110 has on its side opposite the clamp grip 42 a grip surface 114 which extends approximately parallel to the clamp grip 42 or preferably in the direction of an end 116 of the feed lever 100 at an increasing distance from the clamp grip 42.

For displacement of the slide bracket 16 in the clamping direction, the feed lever 100 has, as shown in FIG. 4, a first pressure member 120 lying between the pivot bearing 92 and the clamping spindle 36 and a second pressure member 122 lying between the pivot bearing 92 and the guide rail 10.

Both pressure members 120 and 122 are preferably integrally formed on the feed lever 100 and form with the feed lever in the area of the pivot bearing 92 an approximately triangular lever body 124 facing with a triangle side 126 the slide bracket 16. The triangle side 126 extends parallel to a rear side 128 of the slide bracket 16 facing the triangle side 126.

The pressure members 120 and 122 have rounded pressure surfaces 130 and 132 rising slightly above the triangle side 126 and acting upon the rear side 128 of the slide bracket 16.

When the feed lever 100 is not actuated, the pressure surfaces 130 and 132 are held in abutment on the rear side 128 of the slide bracket 16. This is effected by a drive spring element 134 which surrounds a front side 136 of the slide bracket 16 and engages each of the side portions 72 and 74 of the second wedging element 70, preferably in an area between the pivot bearing 92 and the wedging bolt 78. In the simplest case, the drive spring element 134 is provided with a spiral-shaped spring body 138 which encloses the slide bracket 16 in the shape of a U and rests on the front side 136 thereof. Draw hooks 140 formed on the spring body 138 engage hook receptacles 142 on the side portions 72 and 74, preferably recesses on a side thereof facing away from the slide bracket 16.

Therefore, when the feed lever 100 is not actuated, the second wedging element 70 is always drawn by the drive spring element 134 so far in the direction of the slide bracket 16 that the pressure surfaces 130 and 132 rest without play against the rear side 128 of the slide bracket 16.

A guide housing 150 slidingly guided on the guide rail 10 is provided to ensure that the slide bracket 16 always remains in a wedged position and thus becomes wedged automatically in any position along the guide rail 10. Guide surfaces 152 and 154 arranged on the housing are provided for this purpose on opposite sides of the guide rail 10. The guide surfaces 152 and 154 lie on a guide diagonal 156 which is inclined in the direction opposite to the wedge diagonal 26 in relation to the guide rail.

The housing 150 also forms a bearing support 158 which lies between the guide rail 10 and the clamping spindle 36 and against which the slide bracket 16 can be placed with its front side 136.

The bearing support 158 preferably lies in an area of the slide bracket between the pivot bearing 92 and the end 28 thereof, preferably as close as possible to an area of the slide bracket on which the pressure surface 130 of the first pressure member 120 acts.

A wedging spring element 160 located on a side of the guide rail 10 opposite the bearing support 158 cooperates with the bearing support 158. The wedging spring element 160 is also arranged directly opposite the bearing support 158 in relation to the slide bracket 16 and rests in the direction opposite to the clamping direction against a contact surface 162. The wedging spring element 160 acts on a slide 164 which with projections 170 and 172 rests against a rear side 166 and against a front side 168 of the first wedging element 18 and thus surrounds both sides of the first wedging element 18 at its side facing away from the slide bracket 16.

The slide 164 is acted upon in the direction of the clamping direction 32 by the wedging spring element 160 and thus acts with the projection 170 against the rear side 166 of the wedging element 18, with the overall result that owing to the slide bracket 16 resting with its front side 136 against the bearing support 158, the wedging element 18 is always acted upon in the direction of its wedged position. The force of the wedging spring element 160 is preferably selected such that, independently of which of the pressure members 120 or 122 is acting against the slide bracket 16, also during advancement of the slide bracket 16 in the clamping direction 32, the wedging spring element 160 is capable of holding the first wedging element 18 in its wedged position.

The slide 164 is guided in its entirety, more particularly, in the direction of the clamping direction 32 and in the direction opposite thereto, with guide surfaces 174 in a corresponding guide receptacle 176 of the housing 150. The slide 164 has a manually actuatable pressure surface 178 lying on a side of the first wedging element 18 facing away from the wedging spring element 160. Upon manual actuation of the pressure surface 178, the force of the wedging spring element 160 can be opposed, and by the projection 172 acting against the front side 168 of the wedging element 18, the wedging thereof can be released, for example, in order to displace the entire first clamping element 14 in the direction opposite to the clamping direction 32.

The housing 150 is preferably constructed, as shown in FIGS. 1 and 4, such that it completely encloses the lever body 124, the second wedging element 70 and the first wedging element 18 with a portion of the slide bracket 16, as shown in FIG. 2. The housing 150 also extends with a grip portion 180 surrounding the guide rail 10 in the same direction as the handle 106 of the feed lever 100 and the clamp grip 42. The grip portion 180 preferably encloses the guide rail 10 completely and is guided at its end facing away from the slide bracket 16 with a guide 182 again on the guide rail 10. The grip portion 180 also preferably comprises on its side opposite the handle 106 of the feed lever 100 a bearing surface 184 for a hand, which then serves as support for the palm of the hand when the handle 106 of the feed lever 100 is to be actuated in the direction of the guide rail 10.

In particular, the grip portion 180 is integrally formed on the housing 150.

The inventive clamping device preferably also comprises a second clamping element 190 which may, for example, be constructed in the same way as the first clamping element 14 and may be displaceable on the guide rail 10.

In the simplest case, the clamping element 190 comprises a bracket 192 extending at a right angle to the guide rail 10 and having formed at its front end a clamping surface 194 which faces the clamping surface 52 of the pressure member 48.

Instead of a bracket 192 integrally formed on the guide rail 10, it is, however, also conceivable to provide a fixed bracket which is firmly connected to the rail and similarly has a clamping surface formed thereon.

As shown in FIGS. 6 and 7, in order to install the inventive clamping device and carry out a first clamping of the workpiece 34, the slide bracket 16 is movable with one hand in the clamping direction 32.

To this end, it is possible, as shown in FIG. 6, for the grip portion 180 to lie in the palm of the hand, with the grip portion 180 acting with its bearing surface 184 against the palm of the hand. The fingers can encompass the handle 106 of the feed lever and act, in particular, thereon in the area of the grip curvature 112 and the areas of the first portion 108 and the second portion 110 adjoining it on either side thereof.

Owing to the hand engaging both the handle 106 of the feed lever 100 and the grip portion 180, it is possible to align the inventive clamping device exactly with one hand, and by moving the handle 106 in the direction of the grip portion 180 to move the guide bracket 16 and thus also the pressure member 48 in the clamping direction 32 in the direction towards the second clamping element 190.

In the course of this, as also shown in FIG. 6, the second pressure member 122 acts on the rear side 128 of the slide bracket 16, and, starting from the unactuated position of the feed lever 100, upon first actuation thereof in the direction of the grip portion 180, the second wedging element 70 immediately becomes wedged by tilting in relation to the guide rail 10 and thus sits firmly on the guide rail 10 so that further actuation of the feed lever 100 results in the second pressure member 122 displacing with its pressure surface 132 the slide bracket 16 in the clamping direction 32, which is possible in spite of the maintenance of the wedging thereof by the wedging spring element 160 because the wedging acts only against movement in the direction opposite to the clamping direction 32, but not against movement in the clamping direction 32.

If the feed lever 100 is then released and returns to its initial position, the wedging of the first wedging element 18 by the wedging spring element causes the slide bracket 16 to be no longer movable in the direction opposite to the clamping direction 32, but to be firmly fixed on the guide rail 10, while the drag spring element 138 draws the second wedging element 70 in the direction of the slide bracket again, thereby eliminating its wedging, and causes the wedging element 70 to always follow the slide bracket 16 in the clamping direction 32 with the feed lever 100 no longer actuated. Owing to the drag spring element 138 engaging the second wedging element 70 in an area between the pivot bearing 92 and the guide rail 10, the drag spring element 138 simultaneously causes pivoting of the second wedging element 70, also in the unactuated position of the feed lever 100, so that upon actuation of the feed lever 100, the wedging element 70 immediately becomes wedged on the guide rail 10 again.

When, as shown in FIG. 7, the feed lever 100 is moved in the direction of the clamp grip 42, with the clamp grip 42 likewise lying in the palm of the hand and the fingers encompassing the feed lever 100 preferably in the area of its second portion 110, the first pressure member 120 then acts with its pressure surface 130 against the rear side 128 of the slide bracket 16 and moves it likewise in the clamping direction, and, as described above, in the same way as with the movement of the feed lever 100 in the direction of the grip portion 180, the second wedging element 70 fixes itself immediately by wedging on the guide rail 10, which results in the slide bracket 16 being advanced in the clamping direction 32, and, after release of the feed lever 100, in the same way as described above, the second wedging element 70 follows the slide bracket 16.

After the workpiece to be clamped is lightly clamped between the pressure member 48 and the pressure surface 194 of the second clamping element by movement of the feed lever 100, firm clamping of the workpiece 34 is possible by turning the clamp grip 42 and thus turning the clamping spindle 36. Therefore, with the inventive clamping device the same clamping forces are generatable as with conventional clamp clips, and, preferably, expedient one-hand operation thereof is possible.

To release the workpiece 34, the clamping spindle 36 is turned back by turning the clamp grip 42 and simple sliding of the entire slide bracket 16 is then possible by, for example, the pressure surface 178 of the slide 162 being acted upon with the thumb, with the result that the wedging spring element 160 no longer holds the first wedging element 18 in its wedged position and so the entire first clamping element 14 is then easily displaceable in the direction opposite to the clamping direction 32.

If, upon clamping the workpiece 34, the clamping spindle 36 should be turned back so far that the annular surface 62 of the alignment member 54 is already in engagement with the end face 64 of the end 28 of the slide bracket 16, then on account of the elasticity of the rotary stop member 64, it is still possible to release it by turning the clamping spindle 36 slightly further back by strong turning of the clamp grip 42, and slight turning is sufficient to release the clamping force to such an extent that the wedging of the first wedging element 18 is releasable by actuating the pressure surface 178 of the slide 164.

On account of its deformability, the rotary stop member 54 thus offers the possibility, also if the spindle has been turned back wrongly and a workpiece has been clamped in this position, of releasing the inventive clamping device in a simple way, as the elastic deformability of the rotary stop member 54 creates additional play for turning back the spindle 36.

What is claimed is:

1. A clamping device comprising:

a guide rail, a first clamping element supported on said guide rail and having a first clamping surface formed by a pressure member of a clamping spindle and movable in a clamping direction, a slide bracket guided on and movable along said guide rail and fixable by a first wedging element, said slide bracket carrying a spindle nut through which said clamping spindle extends, a feed device including a second wedging element supportable on said guide rail and a pivotally mounted feed lever lying with its handle between said guide rail and the clamp grip of said clamping spindle, said slide bracket being displaceable in the clamping direction by said feed lever relative to said second wedging element, and a second clamping element supported on said guide rail and having a second clamping surface, wherein said feed lever acts on a first pressure member effective between said second wedging element and said slide bracket such that upon actuation of said feed lever in the direction of said clamp grip of said clamping spindle, said slide bracket is displaceable in said clamping direction relative to said second wedging element.

2. A clamping device as defined in claim 1, wherein said first pressure member is rigidly connected to said feed lever.

3. A clamping device as defined in claim 1, wherein said feed lever is mounted on said second wedging element.

4. A clamping device as defined in claim 3, wherein said feed lever is mounted on said second wedging element for pivotal movement about a pivot axis, and in that upon actuation of said feed lever, said first pressure member is movable in the direction of said slide bracket.

5. A clamping device as defined in claim 1, wherein said first pressure member acts directly on said slide bracket.

6. A clamping device as defined in claim 5, wherein said first pressure member acts on an area of said slide bracket extending between said guide rail and said clamping spindle.

7. A clamping device as defined in claim 1, wherein said feed lever is arranged on said second wedging element such that upon actuation of said feed lever a pressure acting from said feed lever on said second wedging element in the direction opposite to said clamping direction causes wedging of said second wedging element and fixing thereof brought about by said wedging.

8. A clamping device comprising:

a guide rail, a first clamping element supported on said guide rail and having a first clamping surface formed by a pressure member of a clamping spindle and movable in a clamping direction, a slide bracket guided on and movable along said guide rail and fixable by a first wedging element, said slide bracket carrying a spindle nut through which said clamping spindle extends, a feed device including a second wedging element supportable on said guide rail and a pivotally mounted feed lever lying with its handle between said guide rail and the clamp grip of said clamping spindle, said slide bracket being displaceable in the clamping direction by said feed lever relative to said second wedging element, and a second clamping element supported on said guide rail and having a second clamping surface, wherein said feed lever acts on a first pressure member effective between said second wedging element and said slide bracket such that upon actuation of said feed lever in the direction of said clamp grip of said clamping spindle, said slide bracket is displaceable in said clamping direction relative to said second wedging element, and said feed lever acts on a second pressure member effective between said second wedging element and said slide bracket such that upon actuation of said feed lever in the direction of said guide rail, said slide bracket is displaceable by said second pressure member in said clamping direction relative to said second wedging element.

9. A clamping device as defined in claim 8, wherein said second pressure member is fixedly connected to said feed lever.

10. A clamping device as defined in claim 8, wherein said first and said second pressure members are integrally formed on said feed lever.

11. A clamping device as defined in claim 8, wherein said first and said second pressure members are arranged approximately symmetrically in relation to said pivot axis of said feed lever.

12. A clamping device as defined in claim 8, wherein said first and said second pressure members act on the area of said slide bracket lying between said guide rail and said clamping spindle.

13. A clamping device as defined in claim 8, wherein said second pressure member acts on an area of said slide bracket lying between said pivot axis of said feed lever and said guide rail.

14. A clamping device as defined in claim 1, wherein said second wedging element is acted upon by a drive spring element in said clamping direction.

15. A clamping device as defined in claim 14, wherein said drive spring element engages a part which is moved along with said slide bracket.

16. A clamping device as defined in claim 15, wherein said drive spring element is a drag spring element which engages said slide bracket.

17. A clamping device as defined in claim 14, wherein said drive spring element acts on said second wedging element such that said second wedging element stands free of play in a position wedged with said guide rail.

18. A clamping device as defined in claim 1, wherein said first wedging element is rigidly connected to said slide bracket.

19. A clamping device as defined in claim 18, wherein said first wedging element is integrally formed on said slide bracket.

20. A clamping device as defined in claim 1, wherein said first wedging element is acted upon by a wedging spring element which holds said first wedging element in its wedged position also upon actuation of said feed lever.

21. A clamping device as defined in claim 20, wherein said wedging spring element is supported on a housing guided on said guide rail.

22. A clamping device as defined in claim 21, wherein said housing is supported with a bearing support on said first wedging element.

23. A clamping device as defined in claim 21, wherein said bearing support and a place at which said wedging spring element acts on said first wedging element are spaced at as large a distance as possible from one another.

24. A clamping device as defined in claim 20, wherein said housing comprises a bearing for a manually actuatable release member which acts on said first wedging element, the wedging of said first wedging element being releasable by said release member upon actuation thereof.

25. A clamping device as defined in claim 24, wherein said wedging spring element acts on said release member in order to hold said release member and said first wedging element in the wedged position.

26. A clamping device as defined in claim 1, wherein said housing at least partially encloses said first wedging element, said second wedging element and said slide bracket.

27. A clamping device as defined in claim 26, wherein said housing is provided with a grip portion surrounding said guide rail and extending in the area of said handle of said feed lever.

28. A clamping device as defined in claim 26, wherein said housing is movable together with said slide bracket.

29. A clamping device as defined in claim 1, wherein said clamping spindle carries at its end facing said pressure member a rotary stop member made of deformable material.

30. A clamping device as defined in claim 29, wherein in its operative position in an undeformed state, said rotary stop member prevents adjustment of said clamping spindle as far as a completely open position, and the completely open position of said clamping spindle is attainable by deformation of said rotary stop member.

31. A clamping device as defined in claim 29, wherein said rotary stop member serves as an alignment member for said pressure member which is articulatedly connected to said clamping spindle.

* * * * *